US006097151A

United States Patent [19]

Kim et al.

[11] Patent Number: 6,097,151

[45] Date of Patent: Aug. 1, 2000

[54] ALTERNATIVE CURRENT PLASMA DISPLAY PANEL WITH DIELECTRIC SUB-LAYERS

[75] Inventors: Tae Yun Kim; Jin Ho Sunwoo, both of Kyungsangbuk-do, Rep. of Korea

[73] Assignee: Orion Electric Co., Ltd., Kyungsangbuk-do, Rep. of Korea

[21] Appl. No.: 09/000,606

[22] Filed: Dec. 30, 1997

[30] Foreign Application Priority Data

May 29, 1997 [KR] Rep. of Korea ..... 97-21658

[51] Int. Cl.[7] ..... H01J 17/49

[52] U.S. Cl. ..... 313/586; 313/582; 313/584

[58] Field of Search ..... 313/586, 587, 313/583, 584, 585, 582; 174/255, 258

[56] References Cited

U.S. PATENT DOCUMENTS

| | | | |
|---|---|---|---|
| 4,803,402 | 2/1989 | Raber et al. | 313/586 |
| 5,548,186 | 8/1996 | Ota | 313/583 |
| 5,703,437 | 12/1997 | Komaki | 313/587 |

*Primary Examiner*—Vip Patel
*Assistant Examiner*—Joseph Williams
*Attorney, Agent, or Firm*—Jacobson, Price, Holman & Stern PLLC

[57] ABSTRACT

There is disclosed an AC PDP comprising two plates. These two plates are opposite to each other with a plurality of parallel electrodes on one plate being across a plurality of parallel electrodes on the other. The space therebetween, sealed by a side wall, is filled with a discharge gas. A fluorescent layer is formed on the side of one of the plates in the sealed space. Opposite to the fluorescent layer, a dielectric multilayer structure is laminated on the electrodes and covered with an overcoat layer, wherein its sub-layers are of lower fluidity as they are nearer to the overcoat layer. This is accomplished by arranging the sub-layers in such a way that they may be higher in softening temperature as they are nearer to the overcoat layer. Since the sub-layers are made of glass materials, this softening temperature gradient is determined by the content of PbO and/or $B_2O_3$ in each of the sub-layers, ranging from approximately 20–50% by weight and approximately 0.5–12.5% by weight, respectively, based on the total weight of each layer. This multilayer structure effectively prevents cracks from occurring in the overcoat layer upon sintering. Therefore, the problems of the electrode damage and the discharge gas pollution, both attributable to the cracks, can be effectively solved, and a high quality and endurable AC PDP can be provided.

6 Claims, 3 Drawing Sheets

ALTERNATIVE CURRENT PLASMA DISPLAY PANEL WITH DIELECTRIC SUB-LAYERS

BACKGROUND OF THE INVENTION

1. Field of the Invention

The present invention relates, in general, to a plasma display panel (hereinafter referred to as "PDP") and, more particularly, to an alternative current PDP employing a dielectric layer.

2. Description of the Prior Art

As is well known, a PDP is a device which displays pictures by exploiting so-called "gas discharge phenomenon", an electric discharge occurring across two apart points in a gas space when they are applied with an electric potential larger than a critical value.

The PDP of the simplest structure is of direct current type, in which sets of parallel electrodes at right angles to each other are deposited on two plates, with the very small space filled with a discharge gas. In the DC PDP, a pixel, which is defined by each intersection of two selected electrodes, is energized to produce a gas discharge forming one element of a dot-matrix display.

However, DC PDPs are incapable of high intensity expressions and thus, it is virtually impossible for DC PDPs to display a dynamic image of high resolution. Recently, many improved PDPs have been developed and now, some are being put into practice.

In order to better understand the background of the invention, a description will be given of a conventional technique, in conjunction with some drawings.

Largely, the improved PDPs are based on the principle of such an alternative current PDP as shown in FIG. 1. Two plates P1 and P2 are opposite to each other with a plurality of parallel electrodes E1 on the plate P1 being across a plurality of parallel electrodes E2 on the plate P2. The space sealed by a side wall W is filled with a discharge gas. A fluorescent layer F is formed on the side of the plate P2 in the sealed space in order to increase luminosity and express desired colors. Opposite to the fluorescent layer F, a dielectric layer D is laminated on the electrode E1, through which a discharge occurs and wall charges are formed. Thus, the dielectric layer D confers on the AC PDP a high responsivity and a high intensity when discharging and allows the AC PDP to maintain the discharging, so that a high luminescence brightness can be established. The character B in FIG. 1 stands for barriers for compartmenting the pixels.

Typically, the dielectric layer D is made by printing and calcining glass. This conventional dielectric layer D is apt to frequently cause so-called "ion bombardment". That is, the gas plasma leaks through the fractures formed in the electrodes E1, damaging the electrodes E1.

To overcome this disadvantage, the dielectric layer D is supplemented with a highly dense and uniform overcoat layer V by deposition. Generally, a MgO layer is vapor-deposited as the overcoat layer V.

Referring to FIG. 2, there are illustrated the processes of fabricating such an AC PDP.

First, as shown in FIG. 2A, a plurality of parallel electrodes E1 are formed on a plate P1 (front plate) to be applied with a dielectric layer D.

Next, a glass material is entirely coated over the electrodes E1 by printing and then, subjected to sintering, to give the dielectric layer D.

FIG. 2C is a cross section after MgO is deposited over the dielectric layer D by sputtering, to give an overcoat layer D. With this, the plate P1 is completed.

Separately, a plate P2 (backing plate) is prepared in which a plurality of parallel electrodes E2 are arranged and a fluorescent layer F and barriers are provided thereon. The two plates P1 and P2 are sealed by a sealant W' in such a way that the two sets of the electrodes E1 and E2 are opposite and at right angles to each other, to produce a PDP, as shown in FIG. 2D. For the sealing, a sealant W' is coated on a predetermined region of the plate P2 and the other plate P1 is placed thereon. These integrated plates are brought into a high temperature atmosphere to sinter the sealant W'. In result, a side wall W is formed, bond-sealing the two plates P1 and P2 to each other.

The completed PDPs are brought to market after aging and performance testing. A significant quantity of PDPs have defectives in entirety or locally and thus are wasted. Even after being sold, they are frequently returned defective before the end of the guarantee period.

The causes of the defectives come, in part, from the process of printing or sintering. And, most of the defectives are attributed to a pollution of discharge gas or a local damage of the electrodes. In the latter case, cracks in the overcoat layer V play a critical role. That is, through the cracks, Pb is diffused from the dielectric layer D into the discharge gas and the discharge plasma leaks to damage the electrodes E1.

It was found that the occurrence of cracks in the overcoat layer V is chiefly made after the sealing of the panel. Conventionally, this problem was believed to be attributed to the thermal properties of the overcoat layer V and thus, there have been tried to variously change the heating atmosphere for the sealing process into, for example, more gradually slow heating or cooling atmospheres. However, no particular improvements have been obtained.

It was also found that, although the sealant W' had a sintering temperature, that is, a softening temperature ranging from approximately 400 to 450° C. and MgO, the metal oxide constituent for the overcoat layer V, had a melting temperature of around 1,000° C., the thermal resistance temperature at which no crack occurred in the overcoat layer consisting of MgO, was only approximately 400° C. Further, since MgO was selected by virtue of its showing a similar coefficient of thermal expansion to that of the glassy dielectric layer, the cause of the cracking in the overcoat layer V has not been clear.

SUMMARY OF THE INVENTION

The intensive and thorough research allowed the present inventors to reach to a conclusion that the cracks in the overcoat layer V are not attributed simply to the difference in the thermal properties, such as softening point and coefficient of thermal expansion, between the overcoat layer V and the dielectric layer D, but to the properties of the glass material.

The dielectric layer D is made of a boron glass material comprising $SiO_2$ as a major constituent and oxides, such as $Al_2O_3$, PbO and $B_2O_3$, in a solid solution state. Glass materials are fluids in which creeps occur even at room temperature. Their fluidity is more active as the temperature becomes higher. When it reaches the softening temperature, the fluidity of the glass materials highly increases to the degree that its flow can be observed.

Hence, the reason why cracks occur in the overcoat layer V upon sealing is that, while a flow occurs in the dielectric layer D made of a glass material when the sealant W', made of a glass material, too, is heated at higher than its softening temperature for the sintering, the overcoat layer V, made of a metal oxide, is of no fluidity.

Therefore, it is an object of the present invention to overcome the above problems encountered in prior arts and to provide a PDP comprising a crack-free dielectric layer.

It is another object of the present invention to provide a PDP which is long in life span.

In accordance with the present invention, the above objects could be accomplished by a provision of an alternative current plasma display panel comprising two plates on which sets of parallel electrodes are deposited and arranged opposite and at right angles to each other, with the very small space therebetween filled with a discharge gas, the inside of one of said two plates being sequentially covered with a thick dielectric layer and a thin overcoat layer, said dielectric layer consisting of a plurality of dielectric sub-layers different in physical properties.

BRIEF DESCRIPTION OF THE DRAWINGS

The above and other objects and aspects of the invention will become apparent from the following description of embodiments with reference to the accompanying drawings in which.

DETAILED DESCRIPTION OF THE PREFERRED EMBODIMENT

Figure 1:
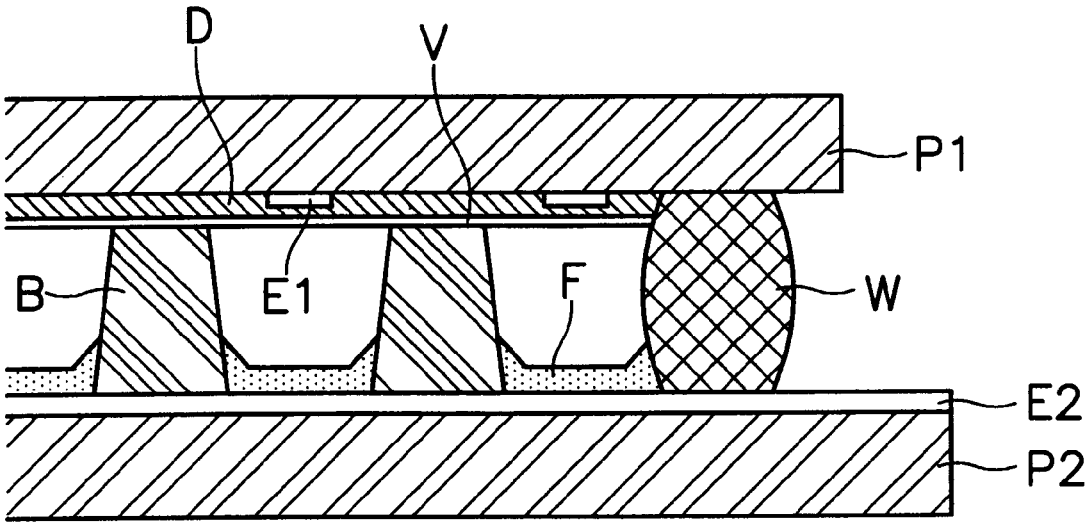
FIG. 1 is a schematic cross sectional view showing a typical structure of an AC PDP.
Figure 2:
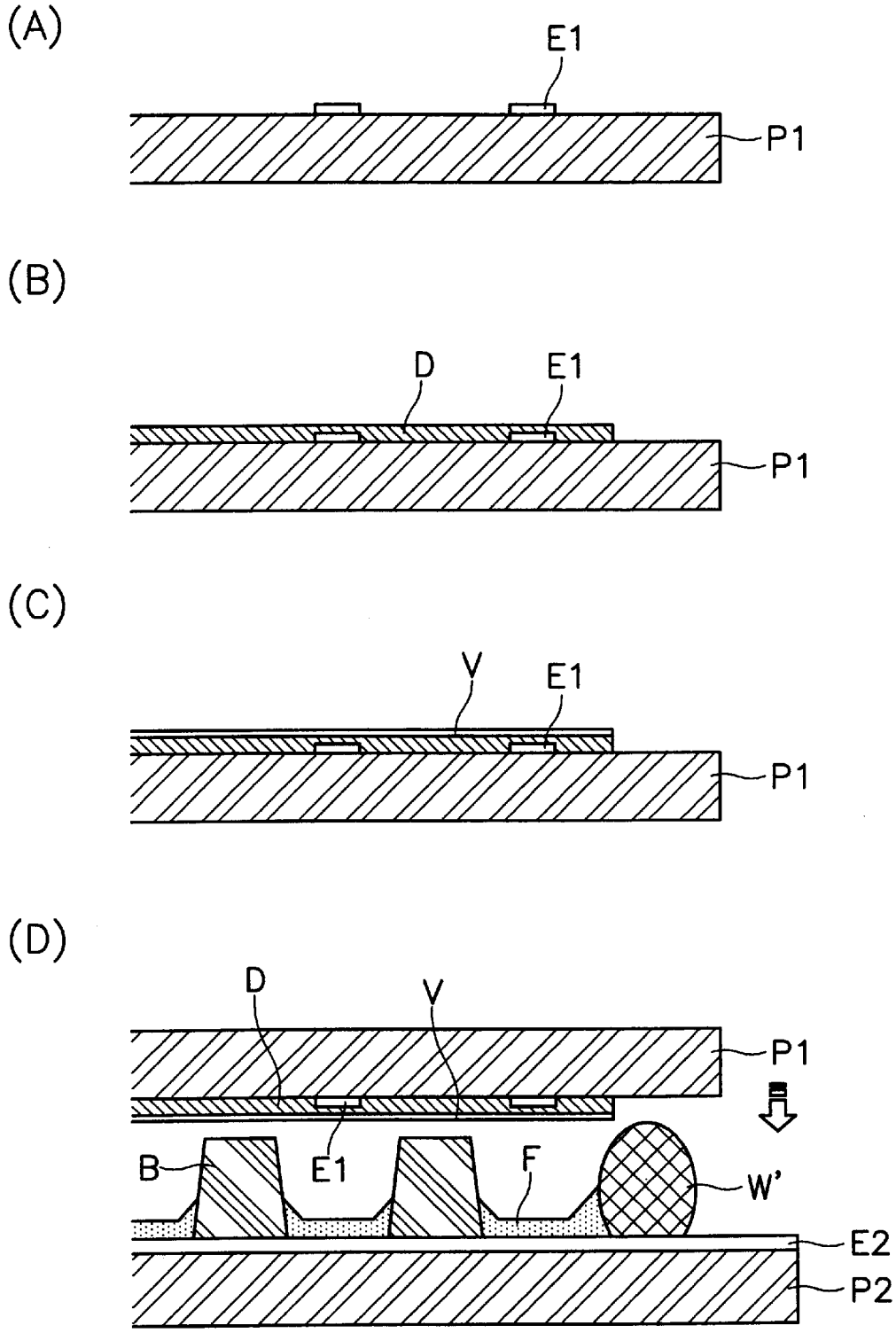
FIGS. 2A through 2D are schematic cross sectional views showing a procedure of fabricating the AC PDP of FIG. 1.

Based on facts revealed by intensive and thorough research, the present invention pertains to a PDP comprising a dielectric layer consisting of a plurality of sub-layers different in physical properties from each other.

Particularly, there is a gradient in the softening temperatures of the dielectric sub-layers. That is, the softening temperature is higher in the dielectric sub-layer which is nearer to the overcoat layer. In this structure, the dielectric sub-layers nearer to the overcoat layer are of lower fluidity, so that the dielectric sub-layer nearest to the overcoat layer serves as a buffer absorbing the flowing impact from the dielectric sub-layer farthest from the overcoat layer upon sealing, preventing cracks from occurring.

Therefore, the absence of cracks in the overcoat layer basically eliminates the possibility that, through the cracks, Pb might be diffused from the dielectric layer into the discharge gas and the discharge plasma might leak, to damage the electrodes in entirety or locally, thereby guaranteeing the life span of the PDP.

The application of the preferred embodiments of the present invention is best understood with reference to the accompanying drawings, wherein like reference numerals are used for like and corresponding parts, respectively.

Figure 3:
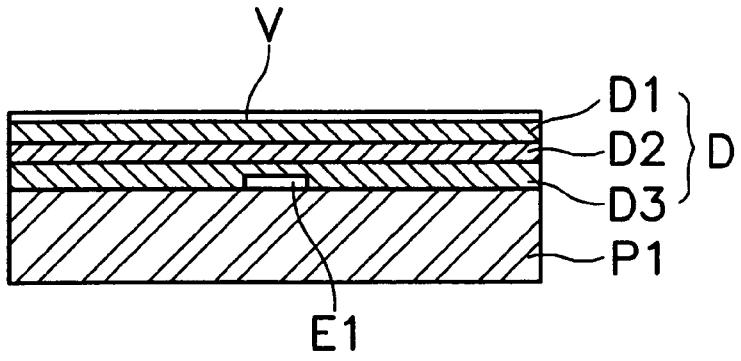
FIG. 3 is a schematic partial cross sectional view showing a structure of an AC PDP according to the present invention.

Referring to FIG. 3, there is partially shown a plate useful for the PDP of the present invention.

As shown in FIG. 3, an electrode E1 is placed on a plate P1 and a dielectric layer D and a overcoat layer V are sequentially formed thereon. The overcoat layer V is made of MgO and thinly deposited by a vapor deposition process as a supplement for the case in that the dielectric layer is thickly formed by, for example, a printing process.

In accordance with the present invention, the dielectric layer D consists of a plurality of sub-layers, for example, three sub-layers D1, D2 and D3, which are different in physical properties from each other.

The dielectric layer D consists of glass materials comprising $SiO_2$ as a major constituent and oxides, such as $Al_2O_3$, PbO and $B_2O_3$, and, optionally, black or white pigment.

$Al_2O_3$ contributes to the strength of the dielectric layer D. PbO decreases the softening temperature of the glass layer and thus, its sintering temperature, too. In contrast to PbO, $B_2O_3$ increases the softening and sintering temperature of the glass layer. Glass which contains a large quantity of PbO, called lead glass, is widely used for general products by virtue of its low melting point, but is apt to produce large creep and be poor in electrical properties on account of the abundant PbO. Whereas, glass containing a large amount of $B_2O_3$ is used for preparing optical glass or heat resistant glass, such as Pyrex.

Figure 4:
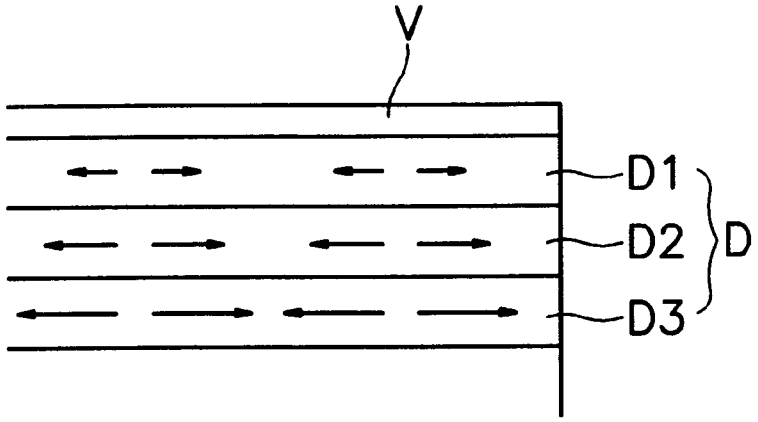
FIG. 4 is a schematic partial cross sectional view for a dielectric layer and a overcoat layer, illustrating the structure principle of the present invention.

Taking advantage of these properties, the present invention makes the dielectric layer D as a multilayer structure in which the sub-layers are of lower fluidity as they are in an upper position, as shown in FIG. 4. That is, the sub-layers are so arranged as to be higher in softening temperature as they are nearer to the overcoat layer V. Thus, at the same temperature, it is harder for a sub-layer to flow than it the one farther from the overcoat layer V.

This structure can be accomplished by modulating the composition of typical glass material, for example, decreasing the content of PbO or increasing the content of $B_2O_3$ further in the upper sub-layers. Herein, the contents of PbO and $B_2O_3$ are on the order of approximately 20–50% by weight and approximately 0.5–12.5% by weight, respectively, based on the total weight of the layer.

When the sealant W' is subjected to sintering to form the side wall W, there is a fluidity gradient in the sub-layers of the dielectric layer D: the one nearest to the electrode E1 may flow but the one nearest to the overcoat layer V does not. Accordingly, there is little difference in fluidity between the overcoat layer, made of metal oxide, for example, MgO, and its nearest sub-layer, resulting in the prevention of cracks from occurring in the overcoat layer V.

As mentioned above, the sub-layers constituting the dielectric layer D are 2 or more in number. In the case of a bi-layer structure, it is preferable that the sub-layer in contact with the electrode E1 is made to play a main role of dielectric layer while the other layer serves as a buffer for preventing the occurrence of cracks in the upper overcoat layer V.

The sub-layers each are preferably constructed by repeating the procedure of printing and sintering. However, if necessary, all of them may be sintered at once after each sub-layer is formed by a printing technique and dried.

As described hereinbefore, the multilayer structure of the present invention, consisting of glass sub-layers which are gradient in softening temperature, effectively prevents cracks from occurring in the overcoat layer when sintering the side wall. Therefore, the problems of the electrode damage and the discharge gas pollution, both attributable to the cracks, can be effectively and basically solved, and a high quality and endurable AC PDP can be provided, according to the present invention.

The present invention has been described in an illustrative manner, and it is to be understood the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

What is claimed is:

1. An alternative current plasma display panel comprising:

two plates on which sets of parallel electrodes are deposited and arranged opposite and at right angles to each other, with a space therebetween filled with a discharge gas, wherein:

the inside one of one of said two plates is sequentially covered with a thick dielectric layer and a thin overcoat layer, said dielectric layer consists of a plurality of dielectric sub-layers different in physical properties, and said dielectric sub-layers are higher in softening temperature as they are nearer to said coating layer.

2. The alternative current plasma display panel in accordance with claim 1, wherein said dielectric sub-layers are made of materials containing PbO with the lower content of PbO in the sub-layers nearer to said coating layer.

3. The alternative current plasma display panel in accordance with claim 2, wherein said PbO is contained at an amount of approximately 20–50% by weight in each of said sub-layers.

4. The alternative current plasma display panel in accordance with claim 1, wherein said dielectric sub-layers are made of materials containing $B_2O_3$ with the higher content of $B_2O_3$ in the sub-layers nearer to said coating layer.

5. The alternative current plasma display panel in accordance with claim 4, wherein said $B_2O_3$ is contained at an amount of approximately 0.5–12.5% by weight in each of said sub-layers.

6. The alternative current plasma display panel in accordance with claim 1, wherein said overcoat layer is made of MgO.

* * * * *